United States Patent [19]

Santamaria Ulecia

[11] 4,432,140

[45] Feb. 21, 1984

[54] DEVICE FOR COPYING PANORAMIC IMAGES

[76] Inventor: Tomas Santamaria Ulecia, Avda. de Bruselas, 58, Madrid - 28, Spain

[21] Appl. No.: 357,320

[22] Filed: Mar. 11, 1982

[30] Foreign Application Priority Data

Mar. 24, 1981 [ES] Spain ..... 257.100

[51] Int. Cl.[3] ..... B43L 13/16

[52] U.S. Cl. ..... 33/20 C; 33/1 K; 33/18 C; 33/22

[58] Field of Search ..... 33/20 C, 1 K, 1 CC, 33/18 C, 20 D, 22, 23 R, 23 C, 23 H

[56] References Cited

U.S. PATENT DOCUMENTS

| | | | |
|---|---|---|---|
| 216,460 | 6/1879 | Rosquist | 33/20 C |
| 424,111 | 3/1890 | Hartsaugh | 33/20 C |
| 529,917 | 11/1894 | Joseph | 33/20 C |
| 805,187 | 11/1905 | Daly | 33/20 C |

*Primary Examiner*—Willis Little

*Attorney, Agent, or Firm*—Wenderoth, Lind & Ponack

[57] ABSTRACT

A device for copying panoramic images includes a screen provided with structure for inclining and fixing the screen. There are defined two like, adjacent sectors successive in height, one of which is transparent and through which the panoramic image to be copied is visible, and the other serving as a graphic board for the reproduction of the panoramic image. The screen is provided with means for transferring the image and preferably a transparent ruler which can move transversely by sliding or by rolling on wheels or bearings, on end guides and, if necessary, also on a central rail in the line of separation between sectors, or without any rail, by means of wheels and threads, and permanently perpendicular to the line of joining between the transparent sector and the opaque sector of the screen. The ruler is provided with a longitudinal slot wherein there are housed the tracking point and the writing point of a tandem having a separation between these elements which coincides approximately with the height of one of the sectors of the screen.

11 Claims, 5 Drawing Figures

DEVICE FOR COPYING PANORAMIC IMAGES

BACKGROUND AND SUMMARY OF THE INVENTION

The present invention relates to a copying device which permits a panoramic view to be reproduced rapidly and easily, this broad concept of panoramic including a wide range of possibilities, such as landscapes, figures, etc. and which is referred to as a VIDEOGRAPH.

The device of the present invention is based on the use of a screen which defines two like sectors, one of which is transparent, so that a determined panorama, perfectly centered with the help of an element for positioning the point of vision, is visible therethrough. The image which is visible through the transparent sector of the screen, is transferable by means of a ruler-tandem transfer system to the other sector which will be referred to as a graphic sector, whereat there is located a suitable receiving element, such as paper, a board, or the like.

The transfer system includes a slidable ruler and a graphic transfer member or tandem.

The ruler is vertical, is capable of sliding transversally along an assembly comprised of the screen, and is provided with a longitudinal slot through which the tandem itself is capable of sliding vertically, in such a way that a tracking point of the tandem is capable of voluntarily travelling along the complete surface of the transparent sector of the screen, while a writing point of the tandem is in turn capable of travelling along the complete surface of the graphic board, thus maintaining a permanent, accurate correspondence between both sectors of the screen.

More concretely, the screen is preferably provided with a frame through which it is joined to a corresponding fixing or supporting element, such as for example a tripod, a stand, a table or any other suitable element, which frame should be capable of turning with respect to the supporting element, in order to achieve the most suitable position therefor.

Likewise the screen can, optionally, be folded at the line of separation between the two sectors thereof, to facilitate transportation of the same.

The ruler should move along the screen without constituting an obstacle to vision, without departing from its vertical alignment and without swaying. Accordingly, the ruler is made from a transparent material, the ends of the ruler are provided with lateral extensions which define guide surfaces for the displacement of the ruler with respect to the frame of the screen, and the ruler is suitably designed so as to slide smoothly, moved by the guides of its ends, either by sliding or by rolling on wheels or bearings. Likewise, the frame can optionally be provided with a central cross-member corresponding to the line of separation between the transparent sector of the screen and the graphic board, which guide will cooperate in the displacement of the ruler. For a better functioning of the assembly, the bearings will not only affect the bottom of the guides, but also the side walls thereof, such that a minimum friction exists between the frame and the ruler.

Nevertheless, the ruler can also function without rails, by means of a known wheel and thread system.

Likewise, the movement of the ruler by means of the pair of points of the transfer system can optionally be facilitated with the collaboration of lateral brackets located in the tandem, or with pole-like projections in the ruler which can fit into the tandem.

The tracking point may be installed in the tandem perpendicularly to the screen or in an inclined position with respect thereto, the nature of its effective friction end on the transparent sector of the screen being sufficiently soft so as to prevent the transparent screen from being scratched, in which case the tracking point is in condition to effect transfer of an image.

The writing point, in turn, can likewise adopt a perpendicular or oblique position with respect to the graphic board, being dismountably installed on the tandem in order to permit its progressive approaching to the graphic board as the operative end thereof is worn out, or the substitution thereof by another having like or distinct characteristics, when deemed necessary.

Clearly, the separation between the tracking point and the writing point should coincide with the height of either one of the two sectors of the screen since both should be identical, plus the space existing between them occupied by the intermediate line or cross member, when the same exists.

Due to the combined movement obtained from the transversal displacement of the ruler and the vertical displacement of the tandem, both the tracking point and the writing point can travel along the complete surface of the corresponding sectors of the screen.

To facilitate manipulation of the assembly, the tandem may be provided with a handle which cooperates in the displacement thereof, as well as a counterweight in the point.

At any suitable spot of the frame there is installed an ocular positioning element which will preferably be comprised of a binocular installed on a spacer which permits the distance of the point of observation to be voluntarily adjusted with respect to the transparent sector of the screen, as well as the angle of observation to be varied with respect thereto. Accordingly, the spacer will be mounted on the frame telescopically and in an oscillating manner.

Any one of two eyepieces of the binocular will be covered so as to permit the unilateral observation of the panorama to be copied, wherefore once the image has been followed with one of the two eyepieces and it is again followed with the other, there will be obtained a graphic superposition which gives a remarkable sensation of depth.

Complementing the described structure, it should also be pointed out that the transparent sector of the screen can be comprised of a dimensional magnifying or reducing glass, with the corresponding repercussion which this implies in the graphic board of the screen, or it can be comprised of a mirror on which the image is received by reflection.

Finally, it should also be pointed out that if the image is to be enlarged or reduced, the tracking tandem can be replaced by a pantograph.

BRIEF DESCRIPTION OF THE DRAWINGS

To complement the description which will now be made and for a better understanding of the characteristics of the invention, the present specification is accompanied by a set of drawings, forming an integral part thereof, wherein illustratively and not limiting the following is represented.

DETAILED DESCRIPTION OF THE INVENTION

Figure 1:
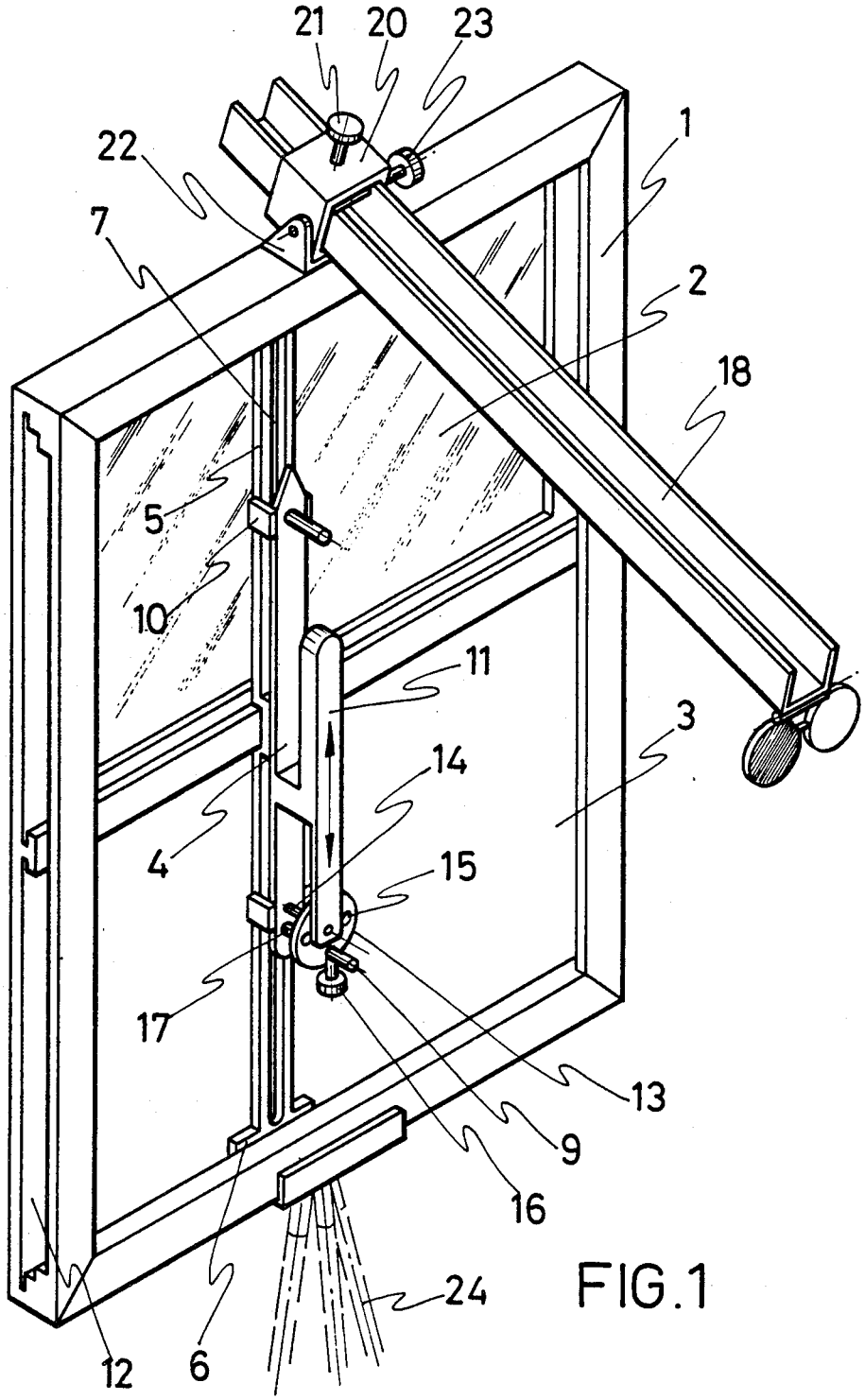
FIG. 1 is a schematic perspective view of a device for copying panoramic images according to the present invention.

Referring to the drawings, it can be seen that the copying device of the present invention includes a screen provided with a frame 1 on which there are defined two like, consecutive sections or sectors, i.e. an upper or first transparent sector 2 and a lower or second sector 3 constituting the graphic board of the assembly.

The upper sector 2 of the screen is used to observe the panorama to be copied, while the graphic board 3 is used to graphically reproduce the view obtained through the sector 2, and will be provided, for such purpose, with the corresponding devices for positioning drawing paper.

Thus, an image appearing on the transparent screen is to be transferred to the graphic board. Therefore, there is used a tandem 4 mounted on a ruler 5 which is transversely displaceable at its ends 6 along the horizontal sectors of the frame 1, while the tandem 4 is vertically displaceable on the ruler 5 itself through a longitudinal slot 7 existing therein.

The tandem 4 has a tracking point 8 and a writing point 9, these elements being spaced from one another by a distance approximately equal to the height of either one of the sectors 2 and 3 of the screen.

As previously mentioned, to achieve proper functioning of the device, the ruler 5 should be displaced along the frame 1 smoothly and without swaying. Therefore the ends 6 of ruler 5 project laterally, thus defining sliding skids provided with corresponding bearings, both frontal and lateral, while the tandem 4 slides on the ruler 5 as well as on the guide determined by the slot 7 itself, with the help of end lateral brackets 10 which slide along lateral faces of the ruler 5.

To facilitate handling of the assembly, the tandem has a handle 11 through which the displacements of both the tandem itself and the ruler 5 are effected.

Figure 3:
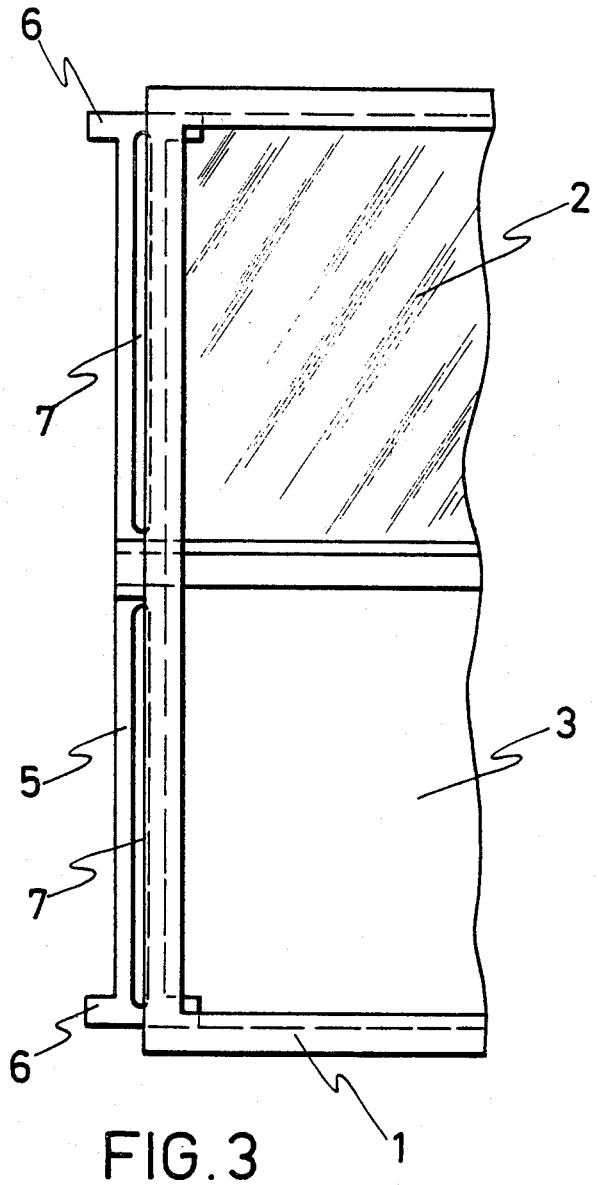
FIG. 3 is a front elevational view of a side section of the copying device.

As can be seen in FIG. 1, the frame 1 is open sideways at 12, such that ruler 5 can be removed through this opening and can emerge sideways from frame 1 (see FIG. 3).

Figure 2:
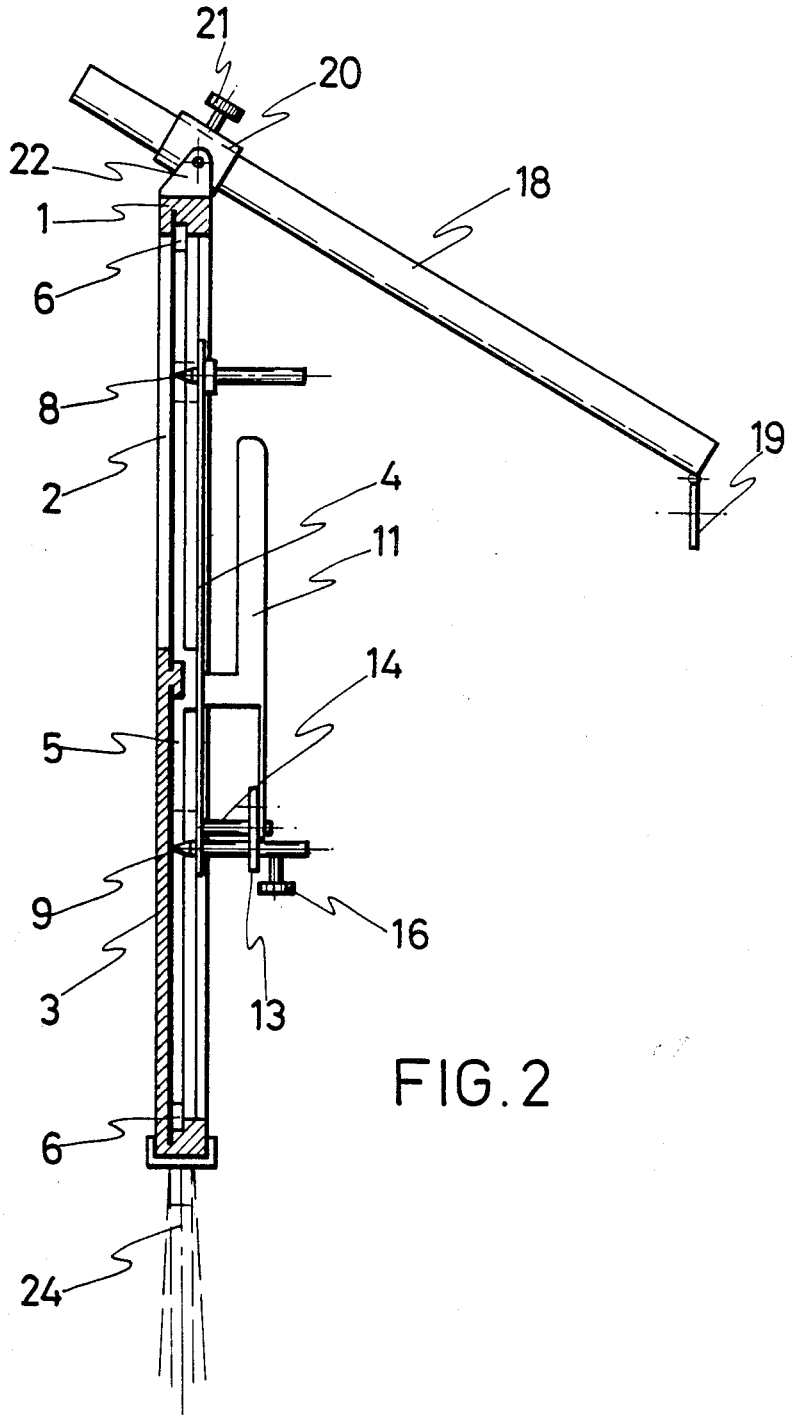
FIG. 2 is a cross-sectional view of the same device.

As also previously mentioned, the tracking point 8 will have a point of incidence on the transparent sector 2 of the screen, which point has a suitable nature to prevent scratching of the screen. While the writing point 9 is interchangeably mounted on the tandem 4 with the help of any suitable device, such as that represented in FIGS. 1 and 2, wherein there is a disc 13 rotatably mounted by means of a shaft 14 on the tandem 4 itself, disc 13 having a perimetral alignment of holes 15 having a different diameter which permit the selective housing in each one of them of a writing point having a different thickness. The operative point being used is fixed with the help of a tightening screw 16 which passes to the graphic board 3 through a hole 17 existing in the body of the tandem 4. Clearly, this is a further solution within the existing wide range of possibilities to solve the problem of interchange of writing points.

Figure 4:
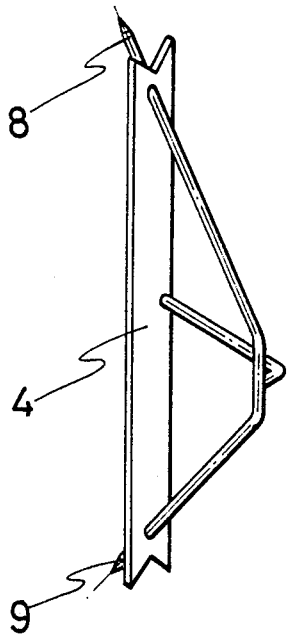
FIGS. 4 and 5 are two schematic views of practical embodiments of a tracking tandem.
Figure 5:
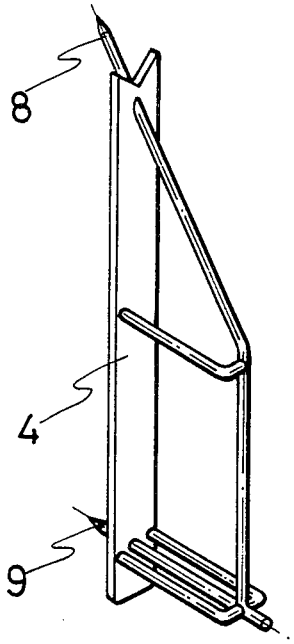

As can be seen from FIGS. 4 and 5, the tracking point 8 and/or the writing point 9 can, apart from being mounted with respect to the screen in respective perpendicular positions, also be mounted with respect thereto in respective oblique positions.

At a suitable position of the frame 1, in the illustrated embodiment on the upper cross-member thereof, there is mounted an ocular positioning element including an arm 18, mounted telescopically and in an oscillating manner with respect to the frame 1, and incorporating at its forward free end a binocular 19 which, in accordance with this telescopic and oscillating assembly, can voluntarily be separated from the transparent sector 2 of the screen, and the angle of observation of which can be varied with respect thereto. Thus, the arm 18 is telescopically displaceable in the interior of a sleeve 20 and is capable of being fixed thereto by means of a tightening screw 21, while sleeve 20 is pivotally mounted on lugs 22 which permit oscillation of sleeve 2, the fixing thereof taking place by means of another tightening screw 23.

In lieu of the arm 18, there can be arranged an extensible arm or a flex-type elastic arm.

As previously mentioned, each one of the eyepieces of the binocular 19 can be covered if desired, so as to observe the panorama through any one of them, or through one of them firstly and then through the other, to achieve a dual reproduction on the graphic board, whereby a sensation of depth is obtained.

The described device can be supported on a tripod 24, as in the embodiment illustrated in the drawings, or on any other conventional supporting element.

In accordance with the described structure, the screen is suitably positioned with respect to the panoramic view to be copied, so that the sector thereof is perfectly centered on the transparent zone 2 of the screen in combination with the adequate and selected position for the binocular 19. In these conditions and once the complete assembly is duly fixed, it is sufficient to follow the different lines of the panorama with the tracking point 8 for the writing point 9 to exactly reproduce the panorama on the graphic board 3 on which a paper, a board or any other suitable element for the reproduction of the image has previously been arranged.

When the drawing paper is arranged on two rolls, so that it passes from one to the other through the graphic board, with a 360° turn for the screen, the complete drawing of the panorama surrounding the device can be obtained.

The visual screen, with the supporting and control systems can be projected as a supplement of a conventional board.

The transfer system can be replaced by a pantograph when the image is to be enlarged or reduced, and magnifying or reducing glasses can also be used for the visual zone of the screen.

I claim:

1. An apparatus for copying panoramic images, said apparatus comprising:

a frame member defining a screen including a first section having a surface for imaging a panoramic image to be copied and a second section having means forming a surface for supporting a copy of the image, said first and second sections being separated by means extending longitudinally in a first direction;

a longitudinal ruler member extending in a second direction transverse to said first direction, said ruler member having opposite ends spaced in said second direction and slidably mounted on said frame member, each said end having means for enabling said ruler member to be slidable with respect to said frame member in said first direction, while maintaining the alignment of said ruler member extending in said second direction, and said ruler member having therein a longitudinal slot extending in said second direction;

a transfer member mounted on said ruler member for sliding movement with respect thereto in said second direction, said transfer member having first and second ends spaced from each other in said second direction;

a tracking point fixed to said first end of said transfer member and adapted to trace along an image imaged on said surface of said first section;

a writing point fixed to said second end of said transfer member and adapted to write on said surface of said second section;

said tracking point and said writing point being spaced from each other in said second direction by a distance substantially equal to the dimension in said second direction of either of said first or second sections; and means, integral with said transfer member, for enabling said transfer member and thereby said ruler member to be moved over said screen, thereby moving said tracking point along the image on said surface of said first section and correspondingly moving said writing point along said surface of said second section, and thereby copying thereon the image.

2. An apparatus as claimed in claim 1, wherein said first section and said ruler member are transparent.

3. An apparatus as claimed in claim 1, wherein said means separating said first and second sections comprises a center rail of said frame, and said ruler member has a portion slidably fitted over said center rail, thereby aiding in guiding sliding movement of said ruler member in said first direction with respect to said frame.

4. An apparatus as claimed in claim 1, wherein said means on each end of said ruler member comprises transverse projections extending in said first direction and defining a widened guiding surface.

5. An apparatus as claimed in claim 1, wherein said tracking point and said writing point extend slidably through said slot in said ruler member.

6. An apparatus as claimed in claim 1, wherein said enabling means comprises a handle integral with said transfer member at a position between said first and second ends thereof.

7. An apparatus as claimed in claim 1, wherein said transfer member has adjacent each of said first and second ends thereof spaced brackets slidably engaging respective lateral faces of said ruler member, thereby guiding movement of said transfer member with respect to said ruler member.

8. An apparatus as claimed in claim 1, wherein at least one lateral side of said frame has therethrough an opening dimensioned to enable the passage therethrough of said ruler member upon sliding movement thereof in said first direction.

9. An apparatus as claimed in claim 1, further comprising a binocular for viewing an image to be imaged on said surface of said first section, and mounting means for mounting said binocular to said frame for selective telescopic movement toward and away from said first section and for selective pivotal movement with respect to said first section.

10. An apparatus as claimed in claim 9, wherein said mounting means comprises a longitudinal arm having mounted on a free end thereof said binocular, said arm slidably extending through a sleeve, means for pivotally mounting said sleeve to said frame, first stop means for fixing the relative longitudinal position of said arm with respect to said sleeve, and second stop means for fixing the relative pivotal position of said sleeve with respect to said frame.

11. An apparatus as claimed in claim 1, wherein said first section comprises a mirror.

* * * * *